United States Patent [19]

Sugiyama

[11] 4,394,923

[45] Jul. 26, 1983

[54] THREADED CAP WITH INNER PLUG

[75] Inventor: Hiroaki Sugiyama, Numazu, Japan

[73] Assignee: Ricoh Co., Ltd., Tokyo, Japan

[21] Appl. No.: 337,210

[22] Filed: Jan. 5, 1982

[30] Foreign Application Priority Data

Jan. 14, 1981 [JP] Japan ..... 56-2851[U]

[51] Int. Cl.[3] ..... B65D 41/04

[52] U.S. Cl. ..... 215/329; 215/354

[58] Field of Search ..... 215/329, 350, 354, 277

[56] References Cited

U.S. PATENT DOCUMENTS

| | | | |
|---|---|---|---|
| 3,462,034 | 8/1969 | Friedberg | 215/329 |
| 3,940,005 | 2/1976 | Granat | 215/354 X |
| 3,944,103 | 3/1976 | Cros | 215/350 X |

*Primary Examiner*—Donald F. Norton

*Attorney, Agent, or Firm*—Flynn, Thiel, Boutell & Tanis

[57] ABSTRACT

A bottle cap composed of a cap body and an inner plug to be fitted inside the cap body. The cap body has an annular groove in the upper part of the inner wall. The inner plug is provided, at the uppermost part of the pot-shaped plug body, with an outwardly extending annular radial flange, which is provided on the lower face thereof with an annular shoulder to constitute an upper portion with a larger diameter and a lower portion with a smaller diameter, wherein said larger diameter portion engages said annular groove of the cap body while said smaller diameter portion has a lower face which engages the uppermost brim of the bottle mouth when the cap is mounted on the bottle. Thus the cap of the present invention can be mounted separately in the order of the inner plug and then the cap body, or mounted together in a pre-assembled state, and is always removed as a unit from the bottle.

3 Claims, 10 Drawing Figures

THREADED CAP WITH INNER PLUG

BACKGROUND OF THE INVENTION

1. Field of the Invention

The present invention relates to a bottle cap composed of a cap body and an inner plug fitted therein.

2. Description of the Prior Art

There are already known bottle caps of this sort as shown in FIGS. 1 and 2.

The cap shown in FIG. 1 is composed of a cap body 21 and an inner plug 22, and said cap body 21 is provided with a cylindrical body portion 24 having an internal thread 27, an annular radial flange 25 inwardly extending above said thread 27 and a top plate 23. The inner plug 22 is provided, at the uppermost part of a pot-shaped body 28, with an outwardly extending annular radial flange 26 fitted in an annular groove defined between said top plate 23 and the flange 25, and is further provided with a similar flange 29 below said flange 25 to sandwich said flange 25 between the flanges 26 and 29.

The cap shown in FIG. 2 is also composed of a cap body 31 and an inner plug 32, wherein said cap body 31 is provided with a cylindrical body 34 having an internal thread 37 and a top plate 33 integrally formed with said body, while the inner plug 32 is provided, at the center of the bottom of a pot-shaped body 38, with a vertical support member 39 which is fixed to the top plate 33 for attaching said inner plug 32 to the cap body 31.

The filling machine used for fitting the cap of the above-mentioned sort on a bottle is generally designed to fit the inner plug first and then to fit the cap body, after the bottle is filled with a desired content.

However, the cap shown in FIG. 1 or 2 requires a modification in the filling machine since the inner plug is in advance fitted in the cap body.

Also the cap shown in FIG. 1 is inevitably expensive as it is composed of three parts; the inner plug 22, top plate 23 and cap body 24.

On the other hand the cap shown in FIG. 2, in which the inner plug 32 is rigidly attached to the cap body 31, cannot be fitted in the bottle mouth if the inner plug is not sufficiently centered with the bottle mouth.

SUMMARY OF THE INVENTION

The object of the present invention is to provide a cap capable of achieving a reduced cost by a simpler structure composed only of the cap body and the inner plug, allowing the use of conventional filling machines without modification, and ensuring proper fitting of the inner plug with the bottle mouth, thereby preventing the drawbacks in the conventional cap with inner plug.

The above-mentioned object can be achieved in the present invention by a cap composed of a cap body and an inner plug fitted therein, wherein the cap body is provided with an annular groove on the internal wall, while the inner plug is provided at the uppermost part thereof with an outwardly extending radial annular flange which has an annular shoulder on the lower face thereof to define an upper portion with a larger diameter and a lower portion with a smaller diameter, said larger diameter portion being fitted in said annular groove to combine the inner plug with the cap body while said smaller diameter portion engages, at the lower face thereof, the uppermost brim of the bottle mouth when the cap is mounted on the bottle.

Another object of the present invention is to provide a cap allowing easy fitting of the inner plug in the cap body.

This further object can be achieved in the present invention by a cap to be screwed on the bottle, in which the internal diameter of the annular groove provided in the cap body is substantially equal to the internal diameter of the thread ridges, that the external diameter of the annular flange of the inner plug is slightly smaller than said internal diameters and that the upper periphery of the annular flange of the inner plug is provided with an upwardly facing slanted surface to further facilitate the assembly of the inner plug with the cap body.

DETAILED DESCRIPTION OF THE PREFERRED EMBODIMENTS

Now reference is made to FIGS. 3 to 6 showing a first embodiment of the present invention and to FIGS. 7 to 10 showing a second embodiment of the present invention, in which common components in both embodiments are represented by common numbers.

Figure 1:
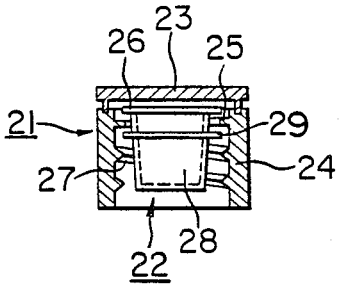
FIG. 1 PRIOR ART
FIG. 1 is an elevation view of a conventional cap with an inner plug in which the cap parts other than the inner plug are shown in cross section.
Figure 2:
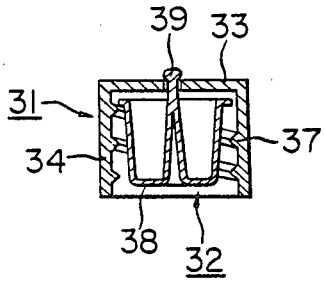
FIG. 2 PRIOR ART
FIG. 2 is a vertical cross-sectional view of another conventional cap with an inner plug.
Figure 3:
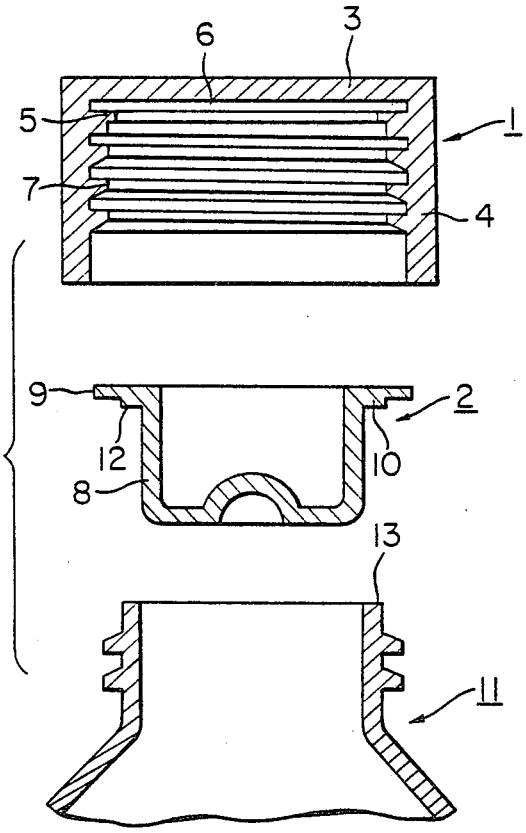
FIG. 3 is a vertical cross-sectional view of a first embodiment of the cap of the present invention in a disassembled state, with a part of the bottle on which said cap is to be fitted.

In FIG. 3 there are shown a cap body 1, an inner plug 2 and a bottle 11.

The cap body 1 is composed of a cylindrical body 4 having an internal thread portion 7 and an integral top plate 3, and further provided, above said thread portion 7 in the cylindrical body 4, with an inwardly extending radial annular flange 5, thus defining an annular groove 6 between said flange 5 and the top plate 3 .

The inner plug 2 is provided, at the uppermost part of a pot-shaped body 8, with an outwardly extending radial annular flange, which has on the lower face thereof an annular shoulder so as to define an upper portion 9 with a larger diameter and a lower portion 10 with a smaller dimeter.

Now there will be explained the procedure of fitting the cap of the above-explained structure on the bottle 11 by means of a filling machine.

Figure 4:
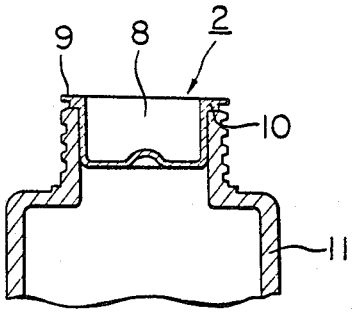
FIG. 4 is a vertical cross-sectional view of the inner plug shown in FIG. 3 fitted on the bottle mouth.

First, the inner plug 2 is pushed into the mouth of the bottle 11 by the fillowing machine as shown in FIG. 4, and the cap body 1 is screwed on said mouth. As it is screwed on, the external periphery of the larger diameter portion 9 of the annular flange provided on the inner plug impinges the ridges of the thread 7 and the internal periphery of the flange 5, but it proceeds to the annular groove 6 due to the elastic deformation of the larger diameter portion. In this manner said portion becomes engaged with said annular groove 6, and the lower face 12 of the smaller diameter portion 10 is maintained in contact with the mouth 13 of the bottle 11 to complete the fitting.

When said cap is removed from the bottle 11, two components are detached together from the bottle since the larger diameter portion 9 of the inner plug 2 is coupled with the annular groove 6 of the cap body 1.

Figure 5:
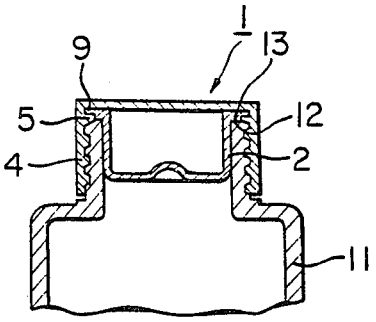
FIG. 5 is a vertical cross-sectional view showing a state when the cap body shown in FIG. 3 is fitted on the inner plug shown in FIG. 4.
Figure 6:
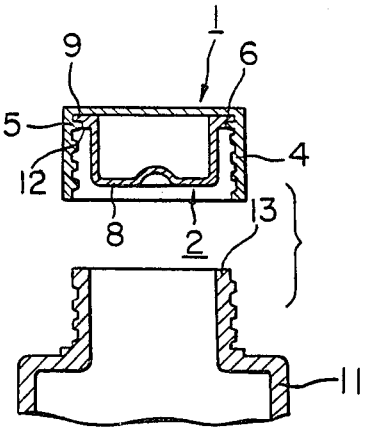
FIG. 6 is a vertical cross-sectional view of the cap of FIG. 5 when it is subsequently detached from the bottle.

Also, the cap in the above-mentioned state can be fitted on the bottle 11 to achieve again the state shown in FIG. 5. In this manner the cap can also be fitted, without the filling machine, on the bottle after it is assembled in advance .

Figure 7:
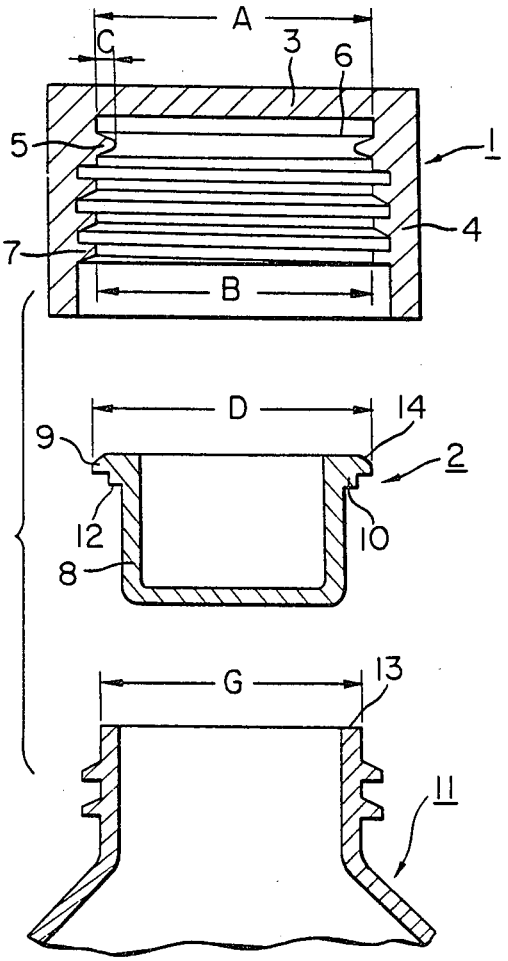
FIG. 7 is a vertical cross-sectional view of a second embodiment of the cap of the present invention in a disassembled state, with a part of the bottle on which said cap is to be fitted.
Figure 8:
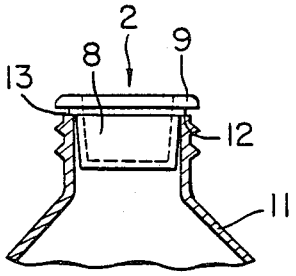
FIG. 8 is a vertical cross-sectional view of the inner plug shown in FIG. 7 fitted on the bottle mouth.
Figure 9:
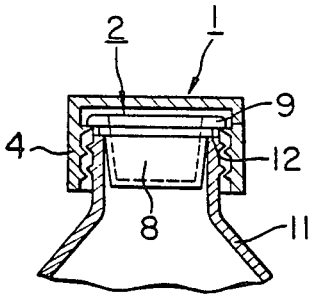
FIG. 9 is a vertical cross-sectional view showing a state in which the cap body shown in FIG. 7 is fitted on the inner plug shown in FIG. 8.

The second embodiment of the present invention differs from the first embodiment in that, as shown in FIG. 7, the upper external periphery of the larger diameter portion 9 constitutes an upwardly facing slanted surface 14, that the internal diameter A of the annular groove 6 is substantially equal to the internal diameter B of the ridges of the thread 7, and that the external diameter D of the larger diameter portion 9 of the inner plug 2 is slightly (by 0.2–0.3 mm) smaller than said internal diameters A and B but is slightly larger (by approximately 0.6 mm) than the diameter G of the bottle mouth. Also, the smaller diameter portion 10 in this case has a width in the order of 1 mm and a height in the order of 0.5 to 1 mm.

Figure 10:
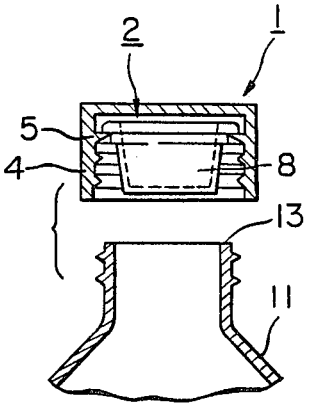
FIG. 10 is a vertical cross-sectional view of the cap of FIG. 9 when it is subsequently detached from the bottle.

As shown in FIGS. 7 and 10, the radially inwardly extending flange 5, which defines the lower wall of the annular groove 6, has a width C which is selected so that the internal diameter of the flange 5 is slightly larger than the diameter of the lower flange portion 10 and slightly smaller than the diameter of the upper flange portion 9.

The cap of such second embodiment can be fitted on or detached from the bottle in the identical manner as the cap of the first embodiment, but the external diameter D of the larger diameter portion selected slightly smaller than the internal diameter B of the thread ridges ensures smooth displacement of the periphery of said larger diameter portion 9 over said thread ridges, and the presence of said slanted surface 14 on the upper periphery of the larger diameter portion facilitates the passage over the internal periphery of the flange 5.

Although particular preferred embodiments of the invention has been disclosed in detail for illustrative purposes, it will be recognized that variations of modifications of the disclosure, including the rearrangement of parts, lie within the scope of the present invention. For example the engagement between the cap body and the bottle is not limited to the screw engagement but includes other conventionally known structures.

What is claimed is:

1. A cap for a container, comprising a cap body and an inner plug fitted therein, said cap body having an annular groove in the inner wall thereof, said inner plug having a cup-shaped body and an outwardly extending annular radial flange on the uppermost portion of said body, said flange having an annular shoulder on a lower face thereof so as to define an upper flange portion and a lower flange portion of smaller diameter than said upper flange portion, said upper flange portion being received in said annular groove in said cap body, and the lower face of said lower flange portion being engageable with the upper edge of the mouth of the container when said cap is fitted on the container, said cap body having a threaded portion on said inner wall thereof and below said annular groove, said threaded portion having radially inwardly projecting ridges and being engageable with a thread on the container, the internal diameter of said annular groove in said cap body being substantially the same as the internal diameter of said ridges of said threaded portion, and the external diameter of said annular flange on said inner plug being slightly smaller than said internal diameters of said annular groove and said ridges.

2. A cap according to claim 1, wherein the periphery of said annular flange on said inner plug includes an upwardly facing slanted surface.

3. A cap according to claim 2, wherein said cap body has a radially inwardly extending annular flange between said annular groove and said threaded portion, the internal diameter of said radially inwardly extending flange being slightly greater than the diameter of said lower flange portion of said inner plug and slightly less than the diameter of said upper flange portion of said inner plug.

* * * * *